US006689686B2

(12) United States Patent
Guldi et al.

(10) Patent No.: US 6,689,686 B2
(45) Date of Patent: Feb. 10, 2004

(54) SYSTEM AND METHOD FOR ELECTROPLATING FINE GEOMETRIES

(75) Inventors: Richard L. Guldi, Dallas, TX (US); Wei-Yung Hsu, Foster City, CA (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/247,000

(22) Filed: Sep. 19, 2002

(65) Prior Publication Data

US 2003/0057099 A1 Mar. 27, 2003

Related U.S. Application Data

(60) Provisional application No. 60/326,070, filed on Sep. 27, 2001.

(51) Int. Cl.[7] ..... H01L 21/44

(52) U.S. Cl. ..... 438/678; 438/625; 438/687; 438/676; 438/637; 438/641; 438/643; 438/674

(58) Field of Search ..... 438/678, 625, 438/687, 676, 637, 641, 628, 643, 14, 17, 674

(56) References Cited

U.S. PATENT DOCUMENTS 6,297,155 B1 * 10/2001 Simpson et al. ..... 438/687
6,340,633 B1 * 1/2002 Lopatin et al. ..... 438/625
6,399,479 B1 * 6/2002 Chen et al. ..... 438/628

FOREIGN PATENT DOCUMENTS

JP 05112893 A * 5/1993 ..... C25D/5/00

* cited by examiner

*Primary Examiner*—Matthew Smith
*Assistant Examiner*—Igwe U. Anya
(74) *Attorney, Agent, or Firm*—Peter K. McLarty; W. James Brady, III; Frederick J. Telecky, Jr.

(57) ABSTRACT

An electroplating system is described which provides for the formation of a conductive layer on a workpiece. The current used to electroplate the workpiece is controlled by a controller. The rotation of the workpiece within a solution containing conductive material is controlled by a rotation controller. The current level and/or rotation of the workpiece is controlled in such a way that the non-uniform growth of large grains within the conductive film is minimized.

9 Claims, 1 Drawing Sheet

SYSTEM AND METHOD FOR ELECTROPLATING FINE GEOMETRIES

This application claims priority under 35 USC § 119(e) (1) of provisional application No. 60/326,070 filed Sep. 27, 2001.

TECHNICAL FIELD OF THE INVENTION

This invention relates in general to the field of electronic device processing and more particularly to an improved system and method for electroplating fine geometries in integrated devices.

BACKGROUND OF THE INVENTION

The ability to create complex integrated electronic devices at reasonable cost is directly related to the ability to create finer and finer geometries on the integrated systems. As some features get smaller, their capacity to carry the current necessary for the operation of these devices is reduced. As such, device designers have turned to more exotic materials within these integrated structures. For example, interconnect and interlevel vias are now constructed from copper which is a much more difficult material with which to work than prior conductive materials.

Copper is difficult to deposit on a surface of a device being constructed without supplying electroplating current. Copper films typically grow in a granular manner. Accordingly, the uniformity of the film depends on the uniformity of the grain size of the copper layer. Inflection points within fine geometries as well as impurities on the outer surface of the device being coated can contribute to non-uniformity in grain sizes. This is especially applicable to the growth of copper films but is also relevant to a variety of other materials used in integrated device processing.

A variety of techniques during the electroplating process have been used to contribute to the creation of uniform layers. Although techniques such as the utilization of variable currents in the plating process and occasional deplating during the electroplating process have proved somewhat successful, they have failed to address the non-uniformities due to inflections within the ever finer geometries of modern integrated systems.

SUMMARY OF THE INVENTION

Accordingly, a need has arisen for a system and method for electroplating integrated electronic devices that provides more uniform grain size even with device geometries having fine features and inflexion points.

In accordance with the teachings of the present invention a system and method of electroplating electronic devices is described that substantially eliminates or reduces problems associated with prior techniques and systems.

According to one embodiment of the present invention, a method for forming a conductive layer on an outer surface of an integrated electronic device is disclosed which comprises providing an electric current through a solution of conductive material and onto the surface of the device to be plated. The electric current can be varied in a smooth fashion to eliminate transient electric fields which can contribute to the irregular formation of grains within the conductive film. The process can include periodic deplating steps which will contribute to the uniformity of the resulting conductive film. Other specific embodiments of the present invention can include systems to vary the rate of rotation of the electronic device within the liquid solution containing the conductive material to further contribute to the uniformity of the conductive film formed through the electroplating process.

An important technical advantage of the present invention inheres in the fact that the variable current electroplating process of the present invention uses smooth transitions to prevent sudden changes in the electric field which can result in the formation of non-uniform conductive grains on the surface being electroplated. A further technical advantage of certain embodiments of the present invention is that the use of periodic deplating steps within the electroplating process can help reduce or remove any large grains which have inadvertently formed near imperfections or inflexions within the geometries to be deplated.

BRIEF DESCRIPTION OF THE DRAWINGS

A more complete understanding of the present invention may be acquired by referring to the accompanying figures in which like reference numbers indicate like features and wherein.

DETAILED DESCRIPTION OF THE INVENTION

Figure 1:
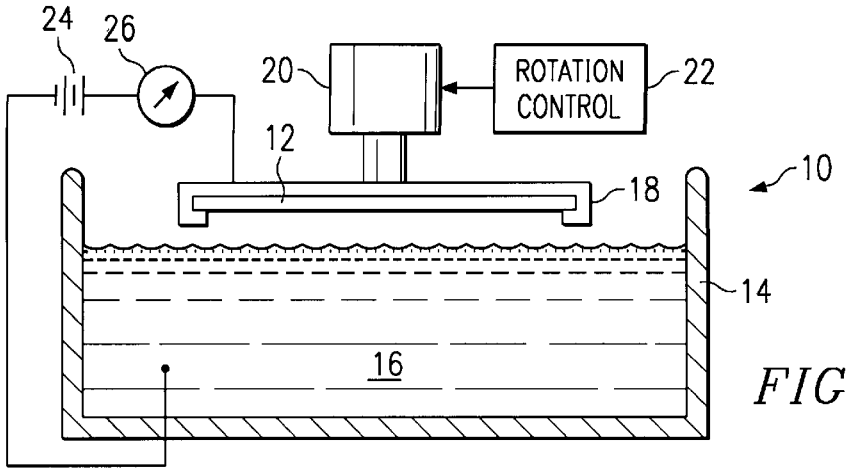
FIG. 1 is a schematic diagram of an electroplating system constructed according to the teachings of the present invention.

Copper and various other conductive films are typically deposited on a semiconductor substrate or other outer layer by a process of electroplating. In this process the workpiece is typically submerged in a liquid solution which includes the conductive material to be deposited on the surface. FIG. 1 is a schematic illustration of an electoplating system indicated generally at 10 which is operable to electroplate a conductive film onto a surface of a workpiece 12. System 10 includes a solution container 14 which contains a liquid solution 16 into which the workpiece 12 can be placed during the electroplating process. The workpiece 12 is physically held in place by an electrically conductive chuck 18. Chuck 18 is connected physically to a rotator 20 which is controlled by a rotation control unit 22. Chuck 18 is electrically connected to a current source 24 through a current controller 26. Current source 24 is connected electrically to the solution 16 to complete the circuit. As will be discussed herein, current source 24 may be operable to induce current both to and from the solution 15 to the workpiece 12 to electrically plate or deplate material onto or from the surface of workpiece 12. As such, although a particular polarity is illustrated in FIG. 1, it should be understood that such polarity may be reserved if necessary during the plating operation.

In general, the workpiece 12 is lowered into the liquid solution 16 and may be rotated by rotator 20 under the control of rotation control 22. Under some circumstances, the workpiece 12 may not be rotated during the initial or other phases of the plating operations. If or when the workpiece 12 is rotated, the speed of the rotation can effect the rate at which the metallic solution is deposited onto the workpiece 12 as well as the character of the film deposited. When the workpiece 12 is submerged in the solution 16 a current is able to flow as controlled by the current controller 26. The electroplating process of depositing the film on the workpiece 12 can be controlled by the amount of current that is allowed to flow by controller 26. In general, the higher the current flowing through controller 26 the faster the metallic material will deposit on the workpiece 12. In addition, the controller 26 is operable to reverse the current and deplate deposited material from the surface of workpiece 12. In this manner, the film can be selectively removed in order to enhance the uniformity of the thickness of the film as it is formed on the workpiece 12.

While electroplating techniques have been known in the past they have not been well adapted to the extremely fine geometries associated with modem integrated circuits. The currents used in electroplating techniques have typically been switched from one current rate to another to merely control the rate at which the electroplating is concerned without thought to the quality of the film and especially the size of the grains within the film as it is deposited. In addition, although deplating techniques have been used they similarly have not been used with a concern towards the equality of the film or the specific formation of grains within the fine geometries of the device.

Figure 2:
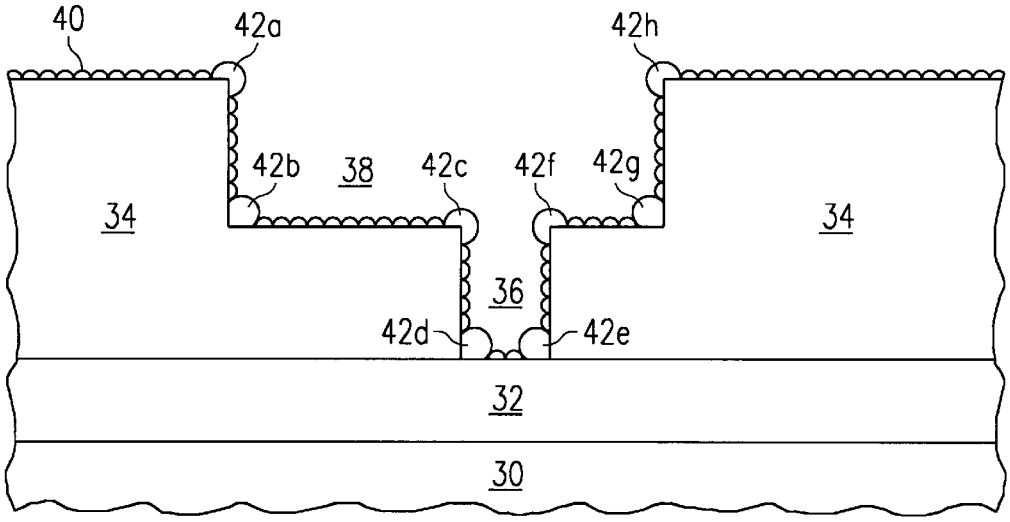
FIG. 2 is a greatly enlarged cross-sectional elevational diagram showing the formation of the initial portions of a conductive layer on an outer surface of an electronic device.

One potential application of the electroplating techniques and systems of the present invention is the formation of interconnects and vias in a dual damascene configuration. FIG. 2 is a cross-sectional diagram which illustrates a semiconductor substrate 30 which has an inner conductive layer 32 formed near an outer surface of the substrate 30. An inter-level insulator layer 34 is formed outwardly from the surface of layer 32. As shown in FIG. 2, a via trench 36 has been formed in the inter-level insulator layer 34 exposing a portion of layer 32. In addition, a outer inner connect trench 38 has also been formed in layer 34 outwardly from trench 36. Using dual damascene techniques, the trench 38 and trench 36 must be filled with a conductive material. If this conductive material is, for, example copper electroplating techniques may be used and the electroplating system 10 can be used to fill the two trenches in sequence.

FIG. 2 also illustrates an initial plated layer 40 which comprises an initial barrier layer, adhering to the outer surface of inter-level insulator layer 34 (not shown), an initial seed layer (not shown) and initial plated material. The outer portions of these layers may comprise a myriad of small grains of copper shown in FIG. 2. Layer 40 also includes larger grains 42*a*, 42*b*, 42*c*, 42*d*, 42*e*, 42*f*, 42*g*, and 42*h*. Layer 40 represents what can happen to a seed layer after it has been plated for some time to result in a disparate rate of growth for larger and smaller grains within the layer. These larger grains 42 occur at inflection points within the geometry of layer 34. For example, grains 42*a*, 42*c*, 42*f*, and 42*h* appear at outer corners of the layer 34 while grains 42*b*, 42*d*, 42*e*, and 42*g* appear at inner corners of the layer 34. The inflection points of the geometry can create convergence points in the electric field which is formed when current is passed through layer 40 during the electroplating process. Because the rate of electroplating activity is dependent upon the strength of this electric field, these convergence points can cause the formation of larger grains of copper at these corners. If steps are not taken within the electroplating process, these larger grains can grow at a much faster rate than the surrounding portions of layer 40. If this process proceeds uncorrected, the layer 40 will not fill the trenches 36 and 38 uniformly but rather will leave voids within the layer severely affecting the operation of the device and especially the conductivity and uniformity of the current flow through the via formed in trench 36 and the innerconnect formed in trench 38.

According to the teachings of the present invention, a number of techniques can be used to control the current flow during the electroplating process to selectively deplate the layer 40 to reduce or eliminate the non-uniform growth of the grains 42 relative to the smaller grains of layer 40. In addition, the rotation of the workpiece 12 under the control of rotation controller 22 can be used to slowly grow a uniform layer at some times during the process and to physically deplate the larger grains 42 of layer 40 during other times within the same process. As will be discussed more completely herein, dramatic changes in the current flow can also create transient effects which are exacerbated at inflection points within the geometries of layer 34. For example, if a current level is dramatically and rapidly changed, non-linear effects can occur at inflection points because of the combination of the convergence of the electric field and the transients within the electric field caused by the attempted rapid change of the current flow. As such, according to the teachings of the present invention, these transient effects are minimized during the plating process and maximized during the deplating process, the net effect of which is to retard the growth of the large grains 42 in favor of the growth of the smaller grains within layer 40.

Figure 3:
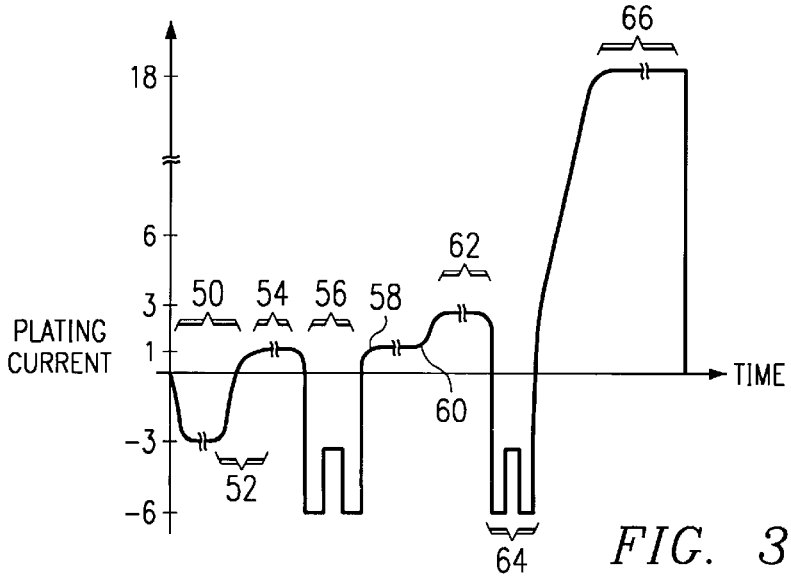
FIG. 3 is a graphical illustration of various techniques used to vary the current during an electroplating process according to the teachings of the present invention.

FIG. 3 is a graphical illustration of the various current levels that may be used over time as various techniques according to the teachings of the present invention may be used to form a conductive layer through plating and deplating steps. Prior to an electroplating process, it is typically understood that a seed layer of material is already present on the outer surface of the work piece. This seed layer may or may not be uniform as it is typically formed using various deposition techniques. As such, the seed layer can be made more uniform by a very slight deplating process at the beginning of the electroplating sequence. As such, FIG. 3 indicates a smooth deplating process indicated generally at 50 where the current level over time is gradually decreased from zero to −3 amps. The duration of time period 50 depends greatly on the initial thickness of the seed layer but it may range anywhere from on the order of one second to ten or fifteen seconds depending upon the amount of deplating required. This seed layer can be the result of sputtering operations alone or the combination of such sputtering operations and minimal electrochemical plating such as might occur during insertion of the wafer into the plating bath. The smooth deplating operations may thus be performed prior to any substantial, electrochemical plating operations. As discussed previously, sudden alterations in the current level such as might be associated with a square wave signal can create transient conditions in the electric field associated with the plating process. These transient conditions associated with sharp corners in the signal can be useful during some deplating operations but should be avoided during plating operations and during smooth deplating operations. The term "smooth" shall be used herein to refer to transitions in the current signal which avoid these sharp, substantially instantaneous changes in the current level and thus minimize the transient conditions within the electric field. By way of example and not limitation, a square wave might transition from one current level to another dramatically different current level in a few milliseconds whereas a smooth transition between two current levels might take anywhere from a hundred milliseconds up to many seconds to complete the transition. Because of the danger of deplating pinholes in the initial plated layer, the initial electrochemical operation indicated at region 50 in FIG. 3 may comprise a smooth deplating operation as shown. It should be understood that the use of an initial smooth deplating operation as shown in region 50 is purely optional and may be omitted if the initial plated layer will not withstand such an operation or if it is not desirable due to other considerations. For example, a slow, smooth initial plating operation may be substituted for the initial deplating operation by reversing the polarity of the current shown in region 50 and by reducing the magnitude of the current level to on the order of 1 amp or less.

If an initial smooth deplating operation is used, the next phase of the plating operation is indicated in region 52 where the current level is gradually and smoothly transitioned from −3 amps to +1 amp. An initial plating operation at one amp is then accomplished as indicated in region 54 of FIG. 3. Depending on the depth of trench 36, the duration of the initial plating process 54 might be anywhere from one second to up to fifteen or twenty seconds.

The initial plating process 54 may be interrupted by a rough deplating step indicated generally at 56 in FIG. 3. A rough deplating operation can be accomplished by rapidly dropping the current level from a positive value to a relatively high negative current such as −6 amps as shown in FIG. 3. During the deplating operation this negative current can be roughly altered from −6 amps to a higher or lower negative current level in a varying number of steps. Region 56 illustrates an example where the current level transitions from −6 amps to −3 amps and then back to −6 amps before returning to a positive current level and continuing the initial plating operation for some period of time. This rough deplating operation uses the instantaneous or near instantaneous transitions of current level to intentionally create transient conditions within the electric field to affect the large grains 42 at the points of incidence within the geometries of layer 34. As such, the large grains which typically form at these points will be more greatly influenced during the deplating operation than the smoother grains surrounding them. The net effect of these operations will be to create more uniformity in the grain size over the entire layer.

In addition, during the rough deplating operation indicated at region 56 in FIG. 3 the rotational control unit 22 can change the rotation speed of the workpiece 12 and further enhance these effects. The deplating operation can be enhanced selectively for larger features by increasing the rotational speed of the workpiece. Once again, this rotational effect will be felt more greatly by larger grains than by smaller grains with the net effect of increasing the uniformity of the grain size. When the plating operation continues the rotational control unit 22 can once again slow the rotation of the workpiece 12 so that slow, uniform film deposition on the workpiece 12 occurs.

Referring again to FIG. 3, following the rough deplating process indicated generally at 56, there is a smooth transition back to a one amp plating process indicated at 58. The slow plating process occurs at one amp for some period of time which may comprise several seconds until there is a smooth transition indicated at 60 to a higher plating process of three amps. According to the example show at FIG. 3, the three amp plating process indicated at region 62 in FIG. 3 continues for some period of time until there is once again a rapid transition to a rough deplating process indicated at 64 in FIG. 3. The rough deplating process 64 may comprise the same or similar steps as were described with reference to the rough deplating process indicated at 56 previously. Following the rough deplating process 64, the current may be transitioned smoothly to a rapid plating process indicated generally at 66. The process 66 may continue for as long as necessary to plate the device to a desired thickness. The termination of the rapid plating process 66 can be rapid because once the plating is completed there is no longer any danger of non-uniform growth in the outer regions of the copper layer.

The current trace shown in FIG. 3 illustrates a number of techniques including smooth deplating operations, rough deplating operations and smooth transitions during plating operations that can be used to first clean a seed layer, then plate fine geometries, and, finally, complete plating operations to a desired thickness. These various techniques have been shown in one example sequence but may be reordered or used in any sequence to plate various device architectures. It should be understood that the presentation of the specific order and current levels shown in FIG. 3 is solely for the purposes of teaching the present invention and should not be construed to limit the present invention to this particular order or this particular current trace. In addition, other current levels may be used to provide for intermediate ranges of plating. For example, instead of immediately transitioning to a high current level of 18 amperes for the rapid plating process the process could plate for some period of time at an intermediate level of five or six amps before transitioning to the high current level.

Accordingly, a variety of plating techniques have been described which all contribute to the creation of a conductive layer which contains uniform grain sizes. The potential creation of voids and inconsistencies within the conductivity of conductive layers that contain non-uniform grain sizes is minimized by inhibiting the growth of large grains through the use of deplating operations and the minimization of rapid changes in the current level during plating operations. In this manner, non-linear growth effects which can contribute to non-uniformity in grain size are minimized or eliminated.

Although the present invention has been described in detail it should be understood that various changes, alterations, substitutions and modifications can be made to the teachings disclosed herein without departing from the spirit and scope of the present invention which is solely defined by the appended claims.

What is claimed is:

1. A method for forming a conductive layer on an outer surface of a substrate, comprising:

providing a semiconductor substrate with an outer surface;

placing the outer surface of the semiconductor substrate in contact with a solution comprising a conductive material, passing electrical current through the solution and the semiconductor substrate so as to cause the conductive material to deposit on the outer surface of the semiconductor substrate under an electromotive force caused by the electrical current;

varying the level of the electrical current from a first current level to a second current level to provide for differing rates of deposition of the conductive material on the outer surface of the semiconductor substrate, wherein the change in the current level from the first current level to the second current level is done in a smooth fashion so that substantially instantaneous changes in current level are avoided to reduce rapid changes in the electrical field near the area where the conductive material is adhering to the outer surface of the semiconductor; and varying the current level by smoothly reversing the flow of current so as to deplate the conductive material from the outer surface of the semiconductor substrate without rapid transient changes in the electrical field for a selected period of time.

2. The method of claim 1 wherein the first current level is no current.

3. The method of claim 1 wherein the first current is a negative current relative to the second current level.

4. The method of claim 1 wherein the smooth deplating operation occurs prior to any substantial electrochemical plating.

5. The method of claim 1 further comprising the step of reversing the current level in an abrupt manner so that the electrical field proximate the area where the deplating of the conductive material occurs undergoes transient effects resulting from the abrupt changes in the level of the reversed current.

6. The method of claim 1 wherein the semiconductor substrate comprises a seed layer of conductive material and wherein the method comprises the step of initially reversing the current level so as to deplate a portion of the seed layer to smooth out non-uniformities and imperfections in the seed layer.

7. The method of claim 1 and further comprising the step of transitioning to a plurality of additional current levels wherein the transition to each positive current level that occurs during a plating operation is conducted in a smooth fashion to avoid abrupt changes in the current level so as to avoid transient effects from the electrical field proximate the area where the plating process is occurring.

8. The method of claim 1 wherein the conductive material comprises copper.

9. The method of claim 1 wherein the outer surface to be coated with the conductive material comprises a trench to be filled with the conductive material.

* * * * *